US009510651B2

(12) United States Patent
Blythe

(10) Patent No.: US 9,510,651 B2
(45) Date of Patent: Dec. 6, 2016

(54) RECLOSABLE FASTENER AND RECLOSABLE BAG HAVING SAME

(71) Applicant: Reynolds Consumer Products LLC, Lake Forest, IL (US)

(72) Inventor: James S. Blythe, Libertyville, IL (US)

(73) Assignee: REYNOLDS CONSUMER PRODUCTS LLC, Lake Forest, IL (US)

( * ) Notice: Subject to any disclaimer, the term of this patent is extended or adjusted under 35 U.S.C. 154(b) by 65 days.

(21) Appl. No.: 13/839,496

(22) Filed: Mar. 15, 2013

(65) Prior Publication Data

US 2014/0259571 A1 Sep. 18, 2014

(51) Int. Cl.
*B65D 33/25* (2006.01)
*A44B 19/62* (2006.01)

(52) U.S. Cl.
CPC ..... *A44B 19/62* (2013.01); *B65D 33/2591* (2013.01); *Y10T 24/45157* (2015.01); *Y10T 29/49782* (2015.01)

(58) Field of Classification Search
CPC ..... B65D 33/2591; A44B 19/16; Y10T 24/2532; Y10T 24/2534; Y10T 24/45157; Y10T 29/49782
USPC ..... 24/582.12, 400, 399, 30.5 R; 383/64
See application file for complete search history.

(56) References Cited

U.S. PATENT DOCUMENTS 5,007,143 A 4/1991 Herrington
5,638,586 A * 6/1997 Malin et al. ..... 24/585.12
6,461,042 B1 * 10/2002 Tomic et al. ..... 383/64
6,581,249 B1 6/2003 Savicki et al.
6,880,972 B2 4/2005 Plourde
7,162,779 B2 * 1/2007 MacHacek ..... 24/399
7,267,856 B2 9/2007 Patel et al.
7,496,992 B2 * 3/2009 Ausnit ..... 24/30.5 R
7,669,307 B2 3/2010 Patel et al.
8,087,826 B1 1/2012 Blythe et al.
2004/0037479 A1 2/2004 Bentsen
2006/0269169 A1 * 11/2006 Kettner et al. ..... 383/5

OTHER PUBLICATIONS

U.S. Appl. No. 13/839,044, filed Mar. 15, 2013.
U.S. Appl. No. 13/841,054, filed Mar. 15, 2013.
U.S. Appl. No. 13/841,054, Oct. 24, 2014 Non-Final Office Action.

* cited by examiner

*Primary Examiner* — Abigail Morrell
(74) *Attorney, Agent, or Firm* — Baker Botts L.L.P.

(57) ABSTRACT

Reclosable fastener includes a first track having a first engagement profile and a first retention feature extending therefrom, the first retention feature disposed substantially level with or above a bottom of the first engagement profile and having a first outward extension and a first upward extension extending upwardly from the first outward extension; a second track having a second engagement profile and a second retention feature extending therefrom, the second retention feature disposed substantially level with or above a bottom of the second engagement profile and having a second outward extension and a second upward extension extending upwardly from the second outward extension; and a slider disposed on the first and second tracks and interlocking the first and second engagement profiles together when moved from an open position toward a closed position along the first and second tracks. A method of forming a reclosable fastener is also provided.

26 Claims, 5 Drawing Sheets

RECLOSABLE FASTENER AND RECLOSABLE BAG HAVING SAME

BACKGROUND OF THE INVENTION

Field of the Invention

The disclosed subject matter generally relates to reclosable fasteners with sliders particularly suited for thermoplastic bags and the like. Particularly, the disclosed subject matter relates to a track and slider configuration with increased strength and flexibility and reduced size.

Description of Related Art

Plastic bags are in widespread use in a varied and diverse number of household and commercial applications, especially in the food packaging industry. One advantage of plastic bags is their ease of opening and resealing. Some of these bags are reclosable via the use of a reclosable feature such as a reclosable fastener. In many bags, the fasteners can be opened and closed either by pressure or by the use of an auxiliary slider mechanism.

Generally, two types of such reclosable fasteners exist—(i) push to close ("PTC") and (ii) zipper. The PTC fastener requires the application of an external force to open or close the engageable tracks, whereas the zipper fastener relies upon a slider for opening or closing the rib and groove elements. As such, the profile configuration of the reclosable track of a zipper fastener often differs from that of a PTC fastener.

In the manufacture of thermoplastic film bags, a pair of male and female fastener elements or tracks extend along the mouth of the bag and these male and female elements are adapted to be secured in any suitable manner to the flexible walls of the thermoplastic film bag. These elements may be integral marginal portions of such walls or the elements may be extruded separately and thereafter attached to the walls along the mouth of the bag. U.S. Pat. Nos. 5,007,143 and 8,087,826, each of which is incorporated by reference in its entirety, describe one type of zipper profile in which the cross-sectional shape of the zipper is such that the male and female elements can be engaged or closed by pressing the bottom together first, then rolling it closed toward the top. This configuration is referred to as a "rolling action" reclosable fastener.

Furthermore, various arrangements have been utilized heretofore to maintain auxiliary slider mechanisms on fasteners. One arrangement which has been used to prevent or inhibit the slider mechanism from going past the ends of the fastener and coming off of the bag is to incorporate opposing end termination clips at the ends of the fastener. The use of end termination clips, however, increases the cost of producing the bag as it requires an additional component on the bag and an additional piece of equipment in order to place the end termination clips on the bag. In addition, the placement of end termination clips on the ends of the fastener involves an additional processing step which may not be desirable when manufacturing speeds are important.

To avoid using end termination clips to prevent or inhibit the auxiliary slider mechanism from going past ends of the fastener, an alternative arrangement has been employed which involves shaping material from the fastener into opposing end stops or end stop structures which protrude from the fastener or zipper and engage the slider mechanism to prevent or inhibit it from going past the respective ends of the fastener. U.S. Pat. Nos. 7,267,856 and 7,669,307, each of which is incorporated by reference in its entirety, describe one technique to shape end stop structures by ultrasonically smashing the opposite ends of the male and female profiles of the fastener to form the protruding end stop structures.

However, there remains an opportunity to improve the seal strength of such conventional fasteners, yet provide a fastener with increased flexibility, for example to permit the fasteners to be easily opened and closed on overstuffed bags. Additionally, there remains an opportunity to provide a fastener with reduced size that can be formed using less material than conventional fasteners.

SUMMARY OF THE INVENTION

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a reclosable fastener including a first track having a first engagement profile and a first retention feature extending therefrom. The first retention feature is disposed substantially level with or above a bottom of the first engagement profile and includes a first outward extension and a first upward extension extending upwardly from the first outward extension. The reclosable fastener further includes a second track having a second engagement profile and a second retention feature extending therefrom. The second retention feature is disposed substantially level with or above a bottom of the second engagement profile and includes a second outward extension and a second upward extension extending upwardly from the second outward extension. The reclosable fastener further includes a slider disposed on the first and second tracks and configured to interlock the first and second engagement profiles together when moved from an open position toward a closed position along the first and second tracks.

As embodied herein, the first and second engagement profiles can be configured to interlock in a horizontal engagement relative to each other. Alternatively, the first and second engagement profiles can be configured to interlock in a vertical engagement relative to each other. As a further alternative, the first and second engagement profiles can be configured to interlock in a rolling engagement relative to each other.

In some embodiments, at least one of the first and second retention features can have a generally L-shaped cross section. At least one of the first and second retention features can have a generally wedge-shaped cross section. As such, the fastener can have a track open force of at least 3 pounds, as determined by ASTM test method F 88/F 88M-09.

Furthermore, and as embodied herein, the first outward extension can define a first width, and the first upward extension can define a first height, the first height being greater than the first width. The second outward extension can define a second width, and the second upward extension can define a second height, the second height being greater than the second width. In some embodiments, the first height can be about 3 times the first width, and the second height can be about 3 times the second width.

According to another aspect of the disclosed subject matter, a reclosable fastener includes a first track having a first engagement profile and a first retention feature extending therefrom, a second track having a second engagement profile and a second retention feature extending therefrom, and a slider disposed on the first and second tracks and engaging the first and second retention features. The slider has a top wall and a bottom surface disposed level with or above a bottom of the first and second engagement profiles and interlocks the first and second engagement profiles together when moved from an open position toward a closed position along the first and second tracks.

As embodied herein, the first retention feature can include a first outward extension and a first upward extension extending upwardly from the first outward extension, and the second retention feature can include a second outward extension and a second upward extension extending upwardly from the second outward extension. The slider can include at least one sidewall extending downwardly from the top wall and having a projection extending therefrom to define at least a portion of the bottom surface of the slider. The at least one sidewall can be configured as a first sidewall and a second sidewall. The projection of the first sidewall can define a bottom boundary of a first channel, and the projection of the second sidewall defining a bottom boundary of a second channel. The projections of the first sidewall and the second sidewall can be configured to engage and inwardly deflect the first and second outward extensions to allow the first and second retention features to be retained within the first and second channels. The first outward projection can define a first undercut and the second outward projection can define a second undercut. The first and second retention features can be configured to be retained within the first and second channels with the projections of the first and second sidewalls abutting the first undercut and the second undercut.

In some embodiments, the slider can include a separating finger extending from the top wall between the first and second sidewalls, and can define a side boundary of each of the first and second channels. The first and second upward projections can be configured to abut the separating finger when the first and second retention features are retained within the first and second channels. The separating finger can interlock the first and second engagement profiles when the slider is moved from the open position to the closed position.

Furthermore, and as embodied herein, the bottom surface of the slider and the a bottom of the first and second engagement profiles can define a gap therebetween. The gap can have a width of about 0.5 millimeters.

According to yet another aspect of the disclosed subject matter, a method of forming a reclosable fastener includes providing a first track having a first engagement profile and a first retention feature extending therefrom, the first retention feature having a first outward extension and a first upward extension extending upwardly from the first outward extension. The method further includes aligning a second track with the first track, the second track having a second engagement profile and a second retention feature extending therefrom, the second retention feature having a second outward extension and a second upward extension extending upwardly from the second outward extension. The method further includes pressing a slider onto the first and second tracks, the slider having a top wall, a first sidewall extending downwardly from the top wall, the first sidewall defining at least a portion of a first channel and having a first projection extending therefrom to define a bottom boundary of the first channel opposite the top wall, a second sidewall extending downwardly from the top wall, the second sidewall defining at least a portion of a second channel and having a second projection extending therefrom to define a bottom boundary of the second channel opposite the top wall, and a separating finger extending from the top wall between the first and second sidewalls, the separating finger defining a side boundary of each of the first and second channels. By pressing the slider on the first and second tracks, the first and second projections engage the first and second outward extensions thereby inwardly deflecting the first and second outward extensions to insert the first and second retention features into the first and second channels, the first and second retention features being retained within the first and second channels by the first and second projections.

DETAILED DESCRIPTION OF THE PREFERRED EMBODIMENT

Reference will now be made in detail to the present preferred embodiments of the application, examples of which are illustrated in the accompanying drawings. The fasteners presented herein generally are intended for thermoplastic bags, although other similar or suitable uses are contemplated. In accordance with the disclosed subject matter, a reclosable fastener is provided. The reclosable fastener includes a first track having a first engagement profile and a first retention feature extending therefrom. The first retention feature is disposed substantially level with or above a bottom of the first engagement profile and includes a first outward extension and a first upward extension extending upwardly from the first outward extension. The reclosable fastener further includes a second track having a second engagement profile and a second retention feature extending therefrom. The second retention feature is disposed substantially level with or above a bottom of the second engagement profile and includes a second outward extension and a second upward extension extending upwardly from the second outward extension. The reclosable fastener further includes a slider disposed on the first and second tracks, and the slider interlocks the first and second engagement profiles together when moved from an open position toward a closed position along the first and second tracks.

According to another aspect of the disclosed subject matter, a reclosable fastener includes a first track having a first engagement profile and a first retention feature extending therefrom and a second track having a second engagement profile and a second retention feature extending therefrom. The reclosable fastener further includes a slider disposed on the first and second tracks and engaging the first and second retention features. The slider has a top wall and a bottom surface disposed level with or above a bottom of the first and second engagement profiles and interlocks the first and second engagement profiles together when moved from an open position toward a closed position along the first and second tracks.

Figure 1:
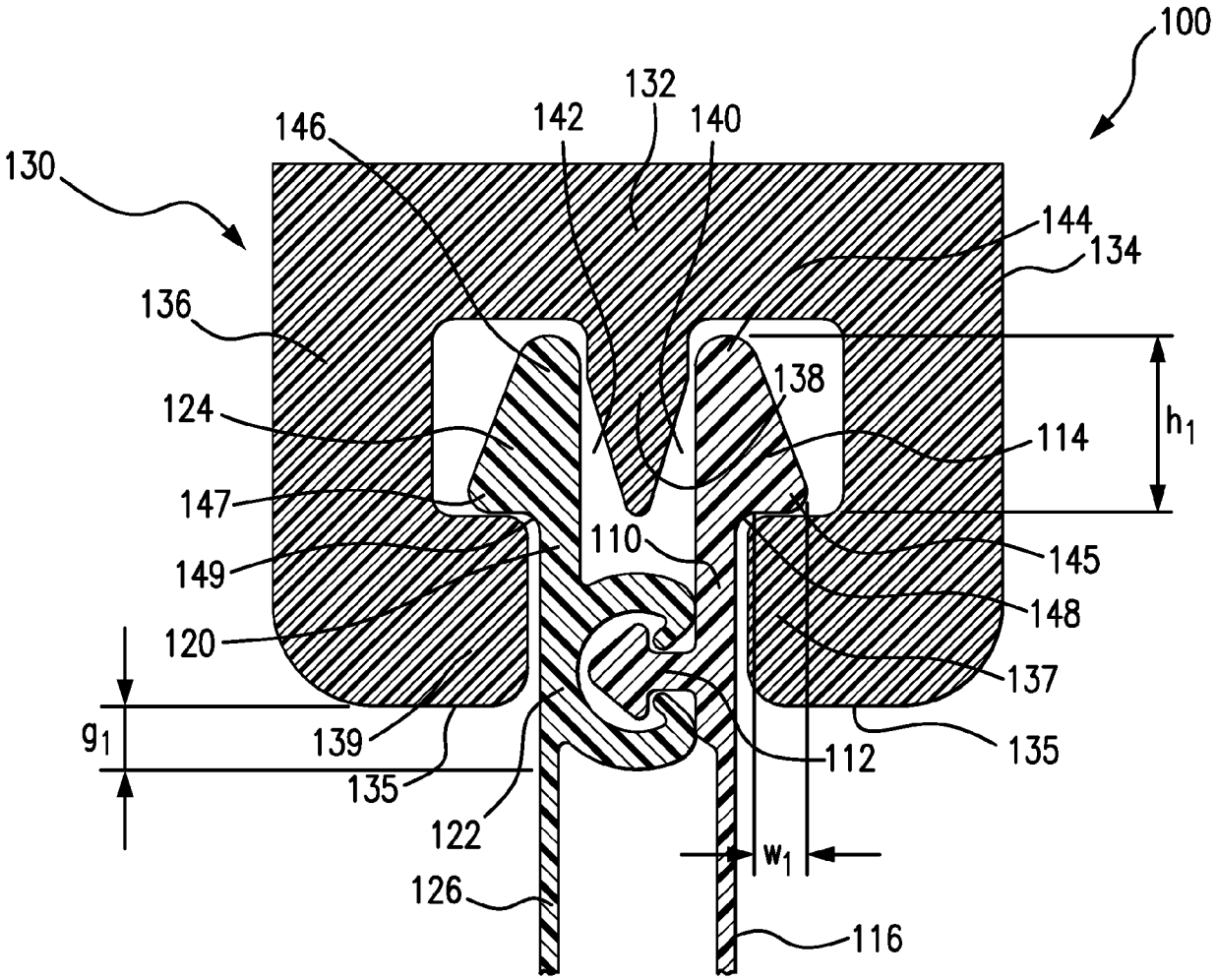
FIG. 1 is a cross-sectional schematic side view of a representative fastener in a closed condition according to the disclosed subject matter.
Figure 2:
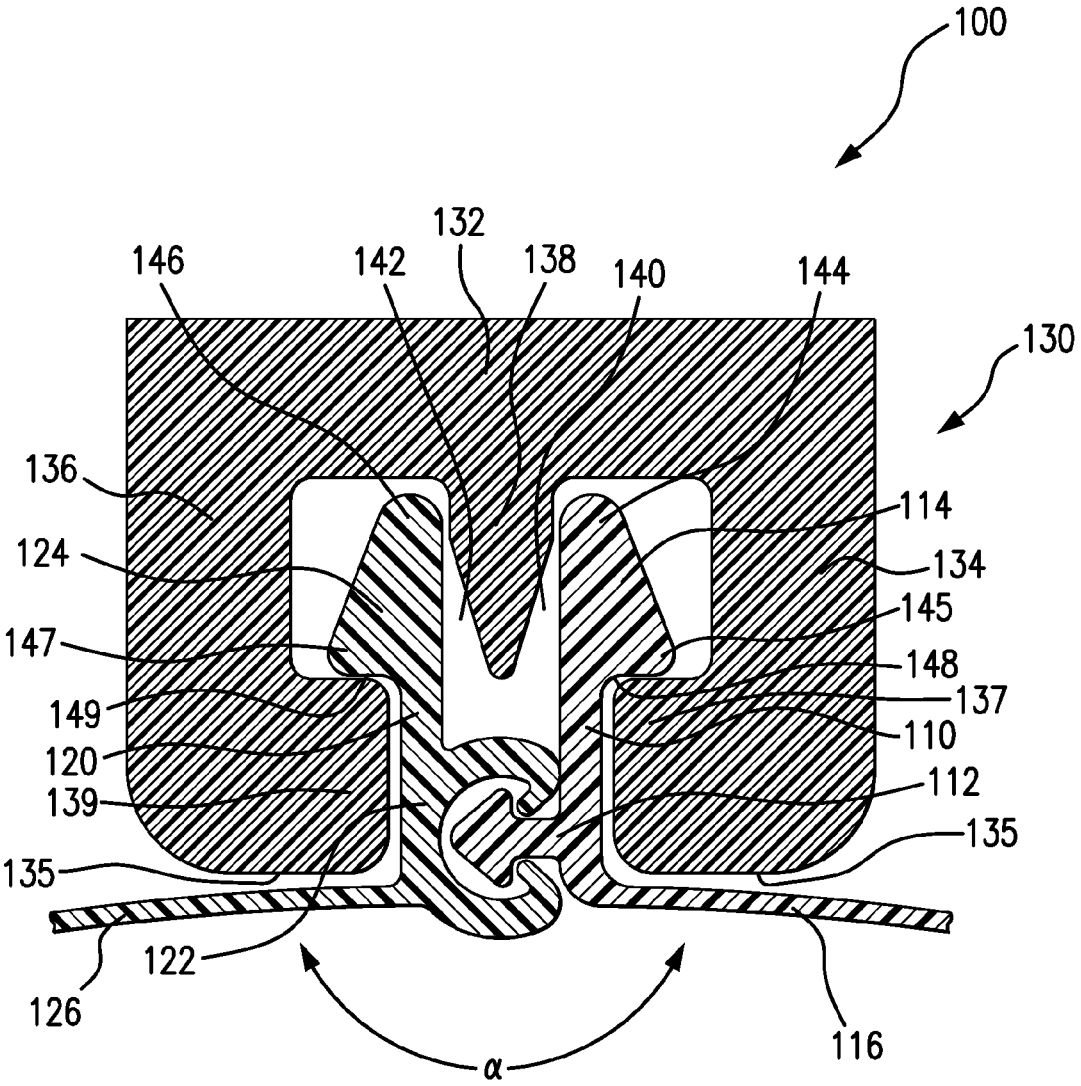
FIG. 2 is a cross-sectional schematic side view of the fastener of FIG. 1 in an overstuffed condition.
Figure 3:
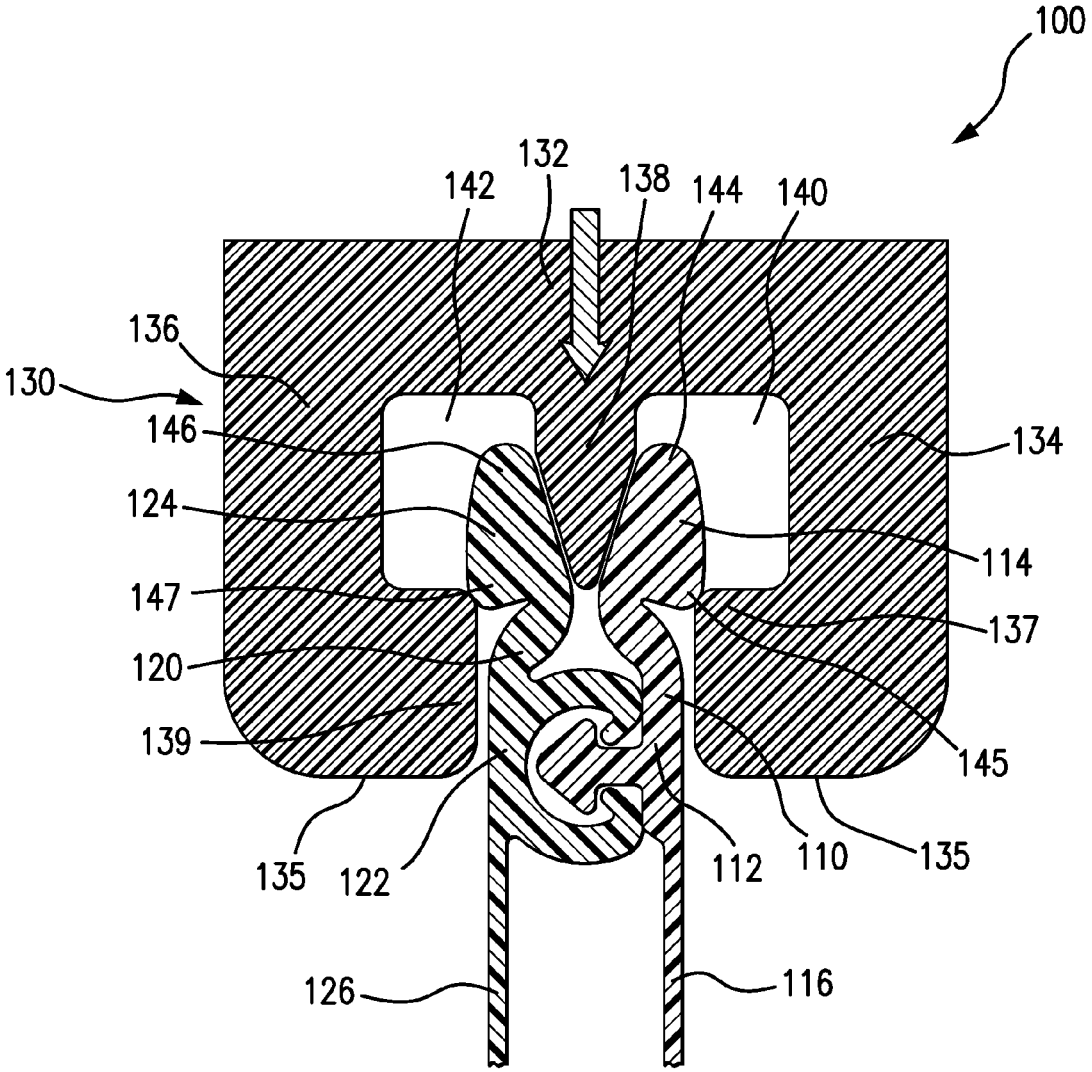
FIG. 3 is a cross-sectional schematic side view illustrating assembly of the fastener of FIG. 1 according to the disclosed subject matter.

For purpose of explanation and illustration, and not limitation, a representative embodiment of a reclosable fastener in accordance with the application is shown in FIGS. 1-3 and is designated generally by reference character 100.

With reference to FIG. 1, the fastener 100 includes a first track 110, a second track 120 and a slider 130 disposed on the first and second tracks. The first track 110 includes a first engagement profile 112. The first engagement profile 112 can be configured, for example and without limitation, as a male engagement profile, and as such can include a rib or other projection. As embodied herein, the first track 110 further includes a first retention feature 114, which can extend from the first engagement profile 112.

The second track 120 includes a second engagement profile 122. The second engagement profile 122 can be configured, for example and without limitation, as a female engagement profile, and as such can include a notch or other opening to receive the projection of the first engagement profile 112 and one or more flanges to engage the first engagement profile 112. As embodied herein the second track 120 further includes a second retention feature 124, which can extend from the second engagement profile 122.

As embodied herein, at least one of the first track 110 and second track 120 can include a fin portion. For example, the first track 110 can include a downwardly-extending fin portion 116, which can be configured, for example and without limitation, as a mating surface to a first panel of a reclosable bag, as further described below. The second track 120 can include a downwardly-extending fin portion 126, which can be configured, for example and without limitation, as a mating surface to a second panel of a reclosable bag, as further described below.

The first engagement profile 112 and the second engagement profile 122 can engage each other in an interlocking engagement at a location of contact when in a closed condition, as shown in FIG. 1. For purpose of illustration and not limitation, as shown in FIG. 1, first engagement profile 112 and second engagement profile 122 interlock in a horizontal engagement. That is, the first engagement profile 112 and the second engagement profile 122 can be configured to engage each other at an angle substantially perpendicular to each other. However, alternative engagement configurations can be utilized in accordance with the disclosed subject matter. For example, first engagement profile 112 and second engagement profile 122 can be configured to interlock in a rolling engagement, such as the rolling engagement described in U.S. Pat. Nos. 5,007,143 and 8,087,826. As a further alternative, first engagement profile 112 and second engagement profile 122 can be configured to interlock in a vertical engagement. That is, the first engagement profile 112 and the second engagement profile 122 can be configured to engage each other at an angle substantially parallel to each other. Further details of an exemplary fastener having a vertical engagement profile are shown with respect to the embodiment of FIG. 4 and further described in the concurrently filed application of James S. Blythe, entitled VERTICAL ACTION RECLOSABLE FASTENER AND RECLOSABLE BAG HAVING SAME, Ser. No. 13/841,054, now U.S. Pat. No. 9,187,215, which is incorporated by reference in its entirety.

A slider 130 is positioned on the first track 110 and second track 120 to matingly engage the first engagement profile 112 and second engagement profile 122 when moved along the first and second tracks from an open position toward a closed position. For example, as embodied herein, in the horizontal engagement configuration, the slider 130 urges first engagement profile 112 and second engagement profile 122 toward each other at an angle substantially perpendicular to each other when moved along the first and second tracks from an open position toward a closed position. Likewise, slider 130 can disengage first engagement profile 112 from second engagement profile 122 when moved from the closed position toward the open position by urging first engagement profile 112 away from second engagement profile 122 at an angle substantially perpendicular to each other.

For example, slider 130 can be configured as an inverted U-shaped plastic member having top wall 132 positioned to move along the first and second tracks proximate to the top edges of the first and second tracks 110, 120. The slider 130 can further include at least one sidewall extending downwardly from the top wall 132. For example and as embodied herein, slider 130 can include a first sidewall 134 extending downwardly from the top wall 132 and a second sidewall 136 extending downwardly from the top wall 132. The first sidewall 134 can be spaced apart from the second sidewall 136. The slider 130 can further have a separator finger 138 shaped throughout the length of the slider 130, extending from the top wall 132 and disposed between the first and second sidewalls. The first sidewall 134 can be spaced apart from the second sidewall 136 a greater distance at an opening end of the slider 130 than at a closing end of the slider 130, corresponding to the direction of movement from the open position to the closed position.

The at least one sidewall can include a projection extending inwardly therefrom and define at least a portion of a bottom surface 135 of the slider 130. For example and as embodied herein, first sidewall 134 can have a first projection 137 extending inwardly therefrom, and the second sidewall 136 can have a second projection 139 extending inwardly therefrom, and thus toward the first projection 137. As such, the first projection 137 can define a bottom boundary of a first channel 140, which can have further boundaries defined by the first sidewall 134, the splitter finger 138 and the top wall 132, and the second projection 139 can define a bottom boundary of a second channel 142, which can have further boundaries defined by the second sidewall 136, the splitter finger 138 and the top wall 132. As discussed in further detail below, the first channel 140 and second channel 142 can be configured to receive first retention feature 114 of first track 110 and second retention feature 124 of second track 120, respectively, to engage slider 130 to the first and second tracks 110, 120.

FIG. 1 shows slider 130 in engagement with first retention feature 114 of first track 110 and second retention feature 124 of second track 120. As shown in FIG. 1, first retention feature 114 can include a first outward extension 145 and a first upward extension 144 extending upwardly therefrom. Likewise, second retention feature 124 can include a second outward extension 147 and a second upward extension 146 extending upwardly therefrom. As such, first upward extension 144 can define a height $h_1$ of the first retention feature 114, and first outward extension 145 can define a width $w_1$ of the first retention feature 114. Similarly, second outward extension 147 and second upward extension 146 can define a width and height, respectively, of the second retention feature. In this manner, first retention feature 114 and/or second retention feature 124 can have a generally wedge-shaped cross section, as shown for example in FIG. 1. Alternatively, first retention feature 114 and/or second retention feature 124 can have a generally L-shaped cross section (as shown for example in FIG. 4) or any other suitable shaped cross section for engagement with and retention within first channel 140 and/or second channel 142 of slider 130.

As shown for example in FIG. 1, the height $h_1$ of the first retention feature 114 can be greater than the width $w_1$ of the first retention feature 114, and additionally or alternatively, the height of the second retention feature 124 can be greater than the width of the second retention feature. For purpose of illustration and not limitation, and as embodied herein, the height $h_1$ of the first retention feature 114 can be about 3 times the width $w_1$ of the first retention feature 114, and additionally or alternatively, the height of the second retention feature 124 can be about 3 times the width of the second retention feature.

The first outward projection 145 can define a first undercut 148 of the first retention feature 114. Similarly, the second outward projection 147 can define a second undercut 149 of the second retention feature 124. As shown for example in FIG. 1, first outward projection 145 can abut the first undercut 148 and second outward projection 147 can abut the second undercut 149 to retain the first and second retention features 114, 124 within the first and second channels 140, 142. Furthermore, with the first and second retention features 114, 124 retained within the first and second channels 140, 142, first retention feature 114 and second retention feature 124 can be disposed proximate to splitter finger 138, and can abut the splitter finger 138, thus restricting movement of the first and second retention features 114, 124 within the first and second channels 140, 142 to maintain the first and second undercuts 148, 149 in abutting engagement with the first and second outward projections 145, 147.

In accordance with one aspect of the disclosed subject matter, as shown in FIG. 1, the bottom surface 135 of slider 130 can be disposed above a bottom of the first and second engagement profiles 112, 122. As such, the bottom surface 135 of the slider 130 and the a bottom of the first and second engagement profiles 112, 122 can define a gap g1 therebetween. The gap g1 can have a width of about 0.5 millimeters, and in some embodiments within a range of about 0.5 millimeters to 1.0 millimeters. Alternatively, the first and second sidewalls 134, 136 can have an increased height and/or the projections 137, 139 can have an increased thickness such that the bottom surface 135 of the slider 130 is disposed approximately level with the bottom of the first and second engagement profiles 112, 122. As a further alternative, the first and second sidewalls 134,136 can have a reduced height and the projections 137, 139 can have a reduced thickness such that the bottom surface 135 of the slider 130 is disposed above the first and second engagement profiles 112, 122, and thus can allow for a fastener 100 having a reduced-sized slider 130.

In accordance with another aspect of the disclosed subject matter, FIG. 2 illustrates reclosable fastener 100 in an overstuffed condition, for example when reclosable fastener 100 is attached to an overstuffed bag. As shown in FIG. 2, rather than projecting downward from the first and second engagement profiles 112, 122, the first and second fins 116, 126 can extend outward from the first and second engagement profiles 112, 122, respectively, such that an angle $\alpha$ formed between the first and second fins 116, 126 can be about 180 degrees.

As embodied herein, the slider 130 is disposed on the first and second tracks 110, 120 above the first and second fins 116, 126, and as such the first and second fins 116, 126 can open to a full 180 degrees without the slider 130 interacting with the first and second fins 116, 126 as the slider 130 moves along the first and second tracks 110, 120. In this manner, the fastener 100 can be closed when the fins 116, 126 are in a fully open configuration, such as when a bag is in an overstuffed condition, without damaging the first and second fins 116, 126, and without forcing slider 130 off of the first and second tracks 110, 120. As such, a bag utilizing fastener 100 can hold the same volume compared to a larger bag having a conventional fastener, and thus can be manufactured with reduced material cost. Additionally or alternatively, in some embodiments, first and second fins 116, 126 can be pre-formed having an opening at about 180 degrees relative to each other.

Furthermore, the 180 degree closure illustrated in FIG. 2 can allow for a fastener 100 having a flat film panel application. As such, a fastener 100 according to the disclosed subject matter can be utilized, for example, as a clothing zipper, tent zipper, fastener for building products, or any other applications utilizing flat film panel application. The flat film panel application can allow for a fastener 100 that can stretch into place and join two flat film panels and withstand pulling forces.

Bags using reclosable plastic fasteners 100 in accordance with the disclosed subject matter were formed and the seal strength was tested. ASTM test method F 88/F 88M-09 was used to test the seal strength of the bags. For fasteners in accordance with the disclosed subject matter, the mean value of the force to open the track was 4.900 lbs. with a standard deviation of 0.484 lbs and a standard Error Mean of 0.217 lbs.

In accordance with another aspect of the disclosed subject matter, a method of forming or assembling a reclosable fastener is provided. The method includes providing a first track having a first engagement profile and a first retention feature extending therefrom, the first retention feature having a first outward extension and a first upward extension extending upwardly from the first outward extension. The method further includes aligning a second track with the first track, the second track having a second engagement profile and a second retention feature extending therefrom, the second retention feature having a second outward extension and a second upward extension extending upwardly from the second outward extension. The method further includes pressing a slider onto the first and second tracks, the slider having a top wall, a first sidewall extending downwardly from the top wall, the first sidewall defining at least a portion of a first channel and having a first projection extending therefrom to define a bottom boundary of the first channel opposite the top wall, a second sidewall extending downwardly from the top wall, the second sidewall defining at least a portion of a second channel and having a second projection extending therefrom to define a bottom boundary of the second channel opposite the top wall, and a separating finger extending from the top wall between the first and second sidewalls, the separating finger defining a side boundary of each of the first and second channels. By pressing the slider on the first and second tracks, the first and second projections engage the first and second outward extensions thereby inwardly deflecting the first and second outward extensions to insert the first and second retention features into the first and second channels, the first and second retention features being retained within the first and second channels by the first and second projections.

FIG. 3 illustrates reclosable fastener being formed or assembled by pressing slider 130 onto first and second tracks 110, 120. With reference to FIGS. 1-3, first track 110 is substantially aligned with second track 120. Slider 130 is pressed onto first track 110 and second track 120. As such, first and second projections 137, 139 of slider 130 engage first and second outward extensions 145, 147 of the first and second retention features 114, 124, respectively. In this manner, the first and second outward extensions 145, 147 inwardly deflect to allow the first and second retention features 114, 124 to pass between the first and second projections 137, 139, respectively, and the splitter finger 138, and into the first and second channels 140, 142. The first and second retention features 114, 124 can then move further into first and second channels 140, 142 until the first and second outward extensions 145, 147 are free to deflect back outwardly, with the first and second undercuts 148, 149 in abutting engagement with the first and second projections 137, 139. As such, the slider 130 is engaged with the first and second retention features 114, 124 of the first and second tracks 110, 120, as shown in FIG. 1. In this manner, the slider 130 can interact with the first and second retention features 114, 124 to achieve a strong, one-way snap-fit engagement, which can be relatively easy to assemble yet difficult to disengage the slider 130 from the first and second tracks 110, 120.

As shown in FIG. 3, the slider 130 can be assembled onto the first and second tracks 110, 120 without bending the slider 130. As such, slider 130 can be formed more simply, using materials having an increased rigidity compared to conventional sliders. Furthermore, slider 130 can provide increased sliding drag for improved performance at engaging and disengaging the first and second engagement profiles 114, 124. The slider 130 can also be installed more easily, and thus at an improved speed compared to conventional, less rigid sliders.

For example and without limitation, slider 130 can be formed from suitable polymeric materials, such as nylon, polypropylene, polyethylene, polystyrene, copolymers of polyethylene and polypropylene, polycarbonates, polyesters, polyacetals, acrylic-butadiene-styrene copolymers or combinations thereof. The slider 130 can be formed, for example, by injection molding.

The first and second tracks 110, 120 can be made of any thermoplastics such as, for example, polyethylenes, including high density polyethylene (HDPE), medium density polyethylene (MDPE), low density polyethylene (LDPE), or mixtures thereof, polypropylene, polyethylene tetraphalate (PET), polyvinyl chloride (PVC), nylon or other suitable materials known in the art. Generally, using a stiffer grade material adds strength. However, because fastener 100 of the disclosed subject matter can include a slider 130 disposed level with or above first and second engagement profiles 112, 122, and thus can be configured to not interact with fins 116, 126, more flexible materials can be used to form the first and second tracks 110, 120.

Figure 4:
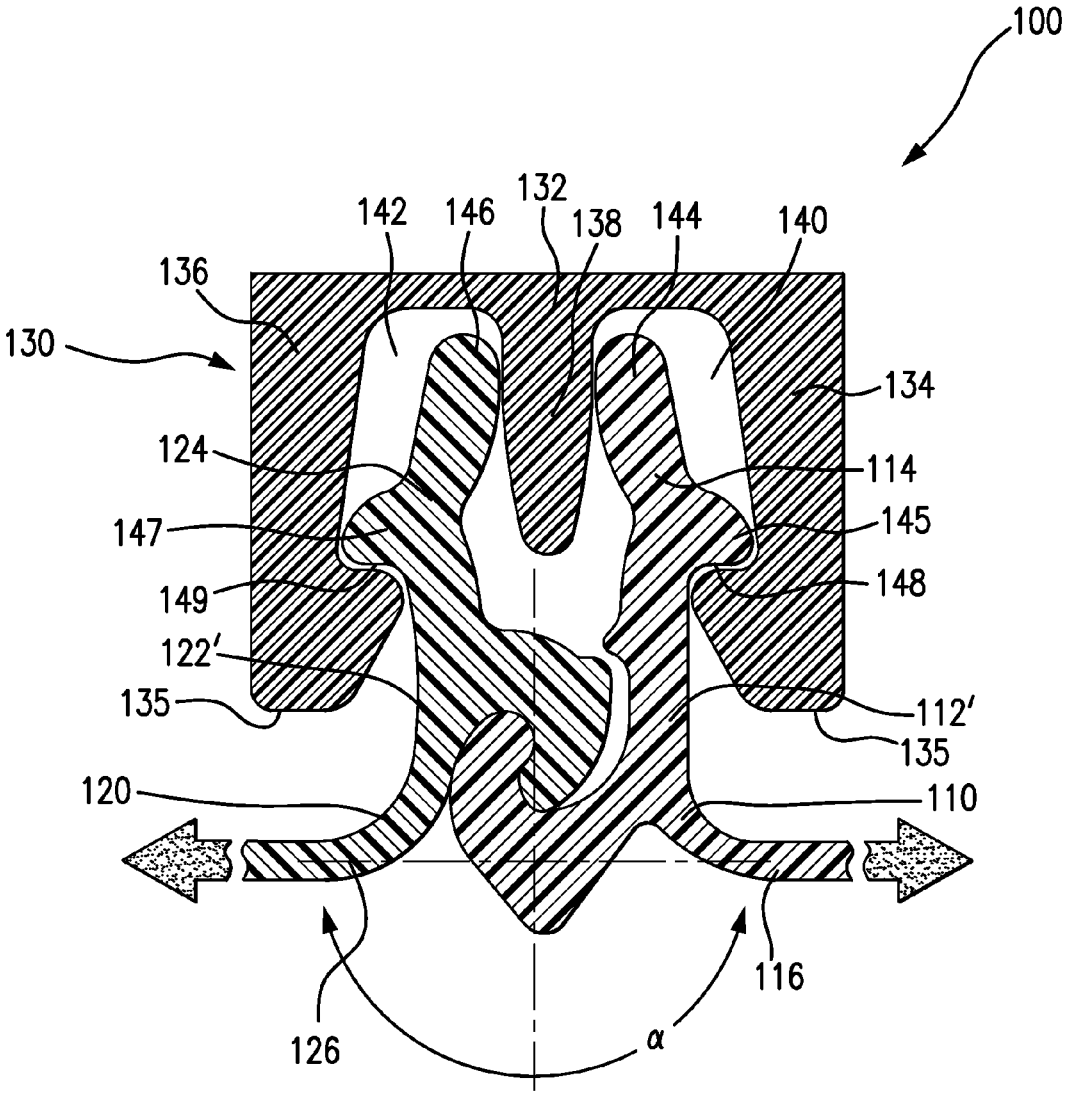
FIG. 4 is a cross-sectional schematic side view of a further representative fastener having an alternative engagement profile configuration according to the disclosed subject matter.

In accordance with another aspect of the disclosed subject matter, FIG. 4 illustrates reclosable fastener 100 having alternative first and second engagement profiles 112', 122'. FIG. 4 shows fastener 100 having first and second engagement profiles 112', 122' in a vertical engagement configuration. Furthermore, in the embodiment of FIG. 4, slider 130 is disposed above the bottom of first and second engagement profiles 112', 122' and above fins 116, 126, which are formed with a 180 degree angle therebetween. As such, fastener 100 can operate with fins 116, 126 in a fully open configuration, such as when a bag is in an overstuffed condition. Additionally, with the vertical engagement of the first and second engagement profiles 112', 122', the first and second engagement profiles 112', 122' disengage in a direction substantially perpendicular to a burst direction of the fastener 100, as shown in FIG. 4. As such, the burst strength of fastener 100 can be improved compared to conventional fasteners. Further details of the vertical action engagement profiles are described in the concurrently filed application of James S. Blythe, entitled VERTICAL ACTION RECLOSABLE FASTENER AND RECLOSABLE BAG HAVING SAME, Ser. No. 13/841,054, now U.S. Pat. No. 9,187,215, which is incorporated by reference herein in its entirety.

Figure 5:
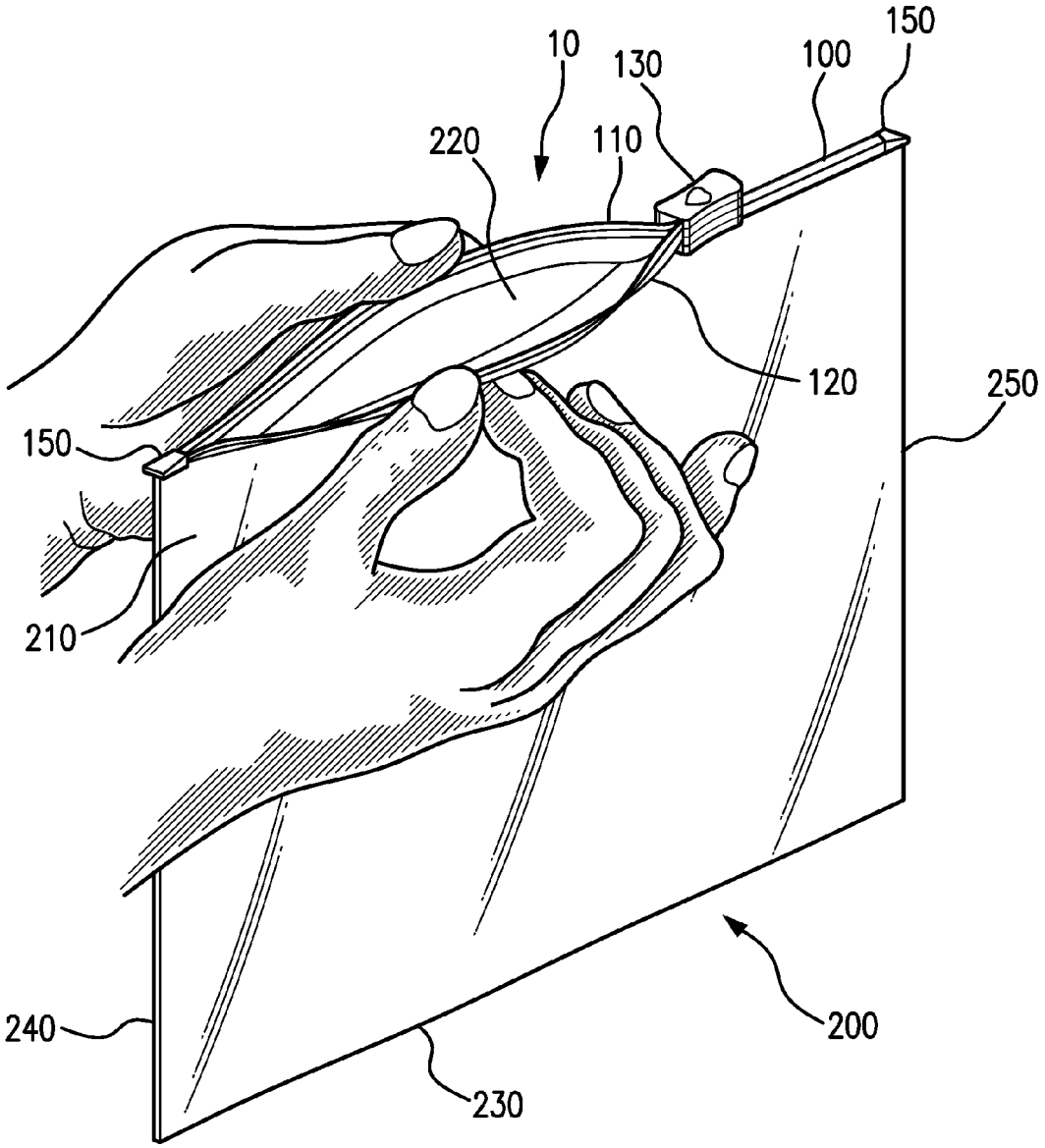
FIG. 5 is a perspective view of a portion of reclosable bag according to the disclosed subject matter.

For purpose of explanation and illustration, and not limitation, FIG. 5 shows an exemplary embodiment of a reclosable bag 200 having a fastener assembly 10 with a fastener 100 in accordance with the disclosed subject matter. As depicted, the reclosable bag 200 includes first and second panels 210 and 220 each having a top, a bottom, and first and second opposing sides and reclosable fastener 100. The first and second panels are joined to each other along respective bottoms 230 and first and second opposing sides 240 and 250. The bag 200 may be made from any suitable thermoplastic film such for example as polyethylene or polypropylene or other suitable materials known in the art. Slider 130 is shown in FIG. 5 assembled on the fastener 100 at the top edge or mouth of a thermoplastic bag 200.

The reclosable fastener 100 can have any combination of the features described above. For example, the fastener 100 can include first and second tracks extending along the length of the top of the first and second opposing sides 210 and 220 and can be extruded separately and attached to the respective sides of the bag mouth, or alternatively, the first and second tracks can be extruded integral with the sides of the bag mouth. Furthermore, end stops 150 can be formed at each of the opposing ends of first and second tracks 110, 120 to prevent movement of the slider beyond the length of the first and second tracks 110, 120. For example and without limitation, further details of exemplary fastener assemblies including first and second tracks with end stops are described in the concurrently filed application of James S. Blythe, entitled "END STOPS FOR RECLOSABLE FASTENER AND RECLOSABLE BAG HAVING SAME," Ser. No. 13/841,054 U.S. Pat. No. 9,187,215, which is incorporated by reference in its entirety.

Reclosable fasteners 100 having first and second tracks 110, 120 with first and second engagement profiles 112', 122', respectively, in accordance with the application were formed and the seal strength was tested. ASTM test method F 88/F 88M-09 was used to test the seal strength of the fasteners.

Specimens were cut to a width of 1.00 inch (with a tolerance of + or −0.5%) using a cutter conforming to the requirements of 5.4 of Test Methods D 882. The edges were clean-cut and perpendicular to the direction of seal. The length of the specimen fins could be of a different length depending on the grip dimensions of the testing machines. To perform the test, a constant rate-of-jaw-separation machine was used. The machine was equipped with a weighing system that moves a maximum distance of 2% of the specimen extension within the range being measured. The machine was equipped with a device for recording the tensile load and the amount of separation of the grips (both being accurate to + or −2%). The rate of separation of the jaws was uniform and capable of adjustment from approximately 8 to 12 inches per minute. The gripping system was capable of minimizing specimen slippage and applying an even stress distribution on the specimen. The machine was calibrated.

Each fin 116, 126 of the fastener 100 was secured in opposing grips of the testing machine and the fastener profiles remaining unsupported while the test was conducted. The fastener profiles were located approximately equidistant between the grips and about 0.25 inches from each of the grips. The specimen was aligned in the grips so that the fastener was perpendicular to the direction of pull while allowing sufficient slack so the fastener is not stressed prior to initiation of the test. The fastener specimen is then tested at a rate of grip separation of 10 inches per minute. For fasteners in accordance with the disclosed subject matter, the mean value of the force to open the track was 4.900 lbs. with a standard deviation of 0.484 lbs and a standard Error Mean of 0.217 lbs.

While the present application is described herein in terms of certain preferred embodiments, those skilled in the art will recognize that various modifications and improvements may be made to the application without departing from the scope thereof. Thus, it is intended that the present application include modifications and variations that are within the scope of the appended claims and their equivalents. Moreover, although individual features of one embodiment of the application may be discussed herein or shown in the drawings of one embodiment and not in other embodiments, it should be apparent that individual features of one embodiment may be combined with one or more features of another embodiment or features from a plurality of embodiments.

In addition to the specific embodiments claimed below, the application is also directed to other embodiments having any other possible combination of the dependent features claimed below and those disclosed above. As such, the particular features presented in the dependent claims and disclosed above can be combined with each other in other manners within the scope of the application such that the application should be recognized as also specifically directed to other embodiments having any other possible combinations. Thus, the foregoing description of specific embodiments of the application has been presented for purposes of illustration and description. It is not intended to be exhaustive or to limit the application to those embodiments disclosed.

The invention claimed is:

1. A reclosable fastener comprising:

a first track comprising a first engagement profile and a first retention feature, the first retention feature disposed above a top of the first engagement profile, the first retention feature comprising a first upward extension extending upwardly above the first engagement profile and defining a top of the first retention feature and a first outward extension extending outwardly from the first upward extension, wherein the first engagement profile has a first interlocking element with an inwardly-extending bottom surface;

a second track comprising a second engagement profile and a second retention feature, the second retention feature disposed above a top of the second engagement profile, the second retention feature comprising a second upward extension extending upwardly above the second engagement profile and defining a top of the second retention feature and a second outward extension extending outwardly from the second upward extension, wherein the second engagement profile has a second interlocking element with an inwardly-extending bottom surface; and a slider disposed on the first and second tracks and having a bottom surface substantially level with or above the bottom surface of each of the first and second interlocking elements, the slider interlocking the first and second engagement profiles together when moved from an open position toward a closed position along the first and second tracks.

2. The reclosable fastener of claim 1, wherein the first and second engagement profiles are configured to interlock in a horizontal engagement relative to each other.

3. The reclosable fastener of claim 1, wherein the first and second engagement profiles are configured to interlock in a vertical engagement relative to each other.

4. The reclosable fastener of claim 1, wherein the first and second engagement profiles are configured to interlock in a rolling engagement relative to each other.

5. The reclosable fastener of claim 1, wherein at least one of the first and second retention features has a generally L-shaped cross section.

6. The reclosable fastener of claim 1, wherein at least one of the first and second retention features has a generally wedge-shaped cross section.

7. The reclosable fastener of claim 1, wherein the fastener has a track open force of at least 3 pounds, as determined by ASTM test method F 88/F 88M-09.

8. The reclosable fastener of claim 1, the first outward extension defining a first width and the first upward extension defining a first height, the first height being greater than the first width.

9. The reclosable fastener of claim 8, the second outward extension defining a second width and the second upward extension defining a second height, the second height being greater than the second width.

10. The reclosable fastener of claim 9, wherein the first height is about 3 times the first width and the second height is about 3 times the second width.

11. A reclosable fastener comprising:

a first track comprising a first engagement profile, a first retention feature extending a first direction therefrom, and a first fin portion extending a second direction therefrom, wherein the first engagement profile has a first interlocking element with an inwardly-extending bottom surface;

a second track comprising a second engagement profile, a second retention feature extending a first direction therefrom, and a second fin portion extending a second direction therefrom, wherein the second engagement profile has a second interlocking element with an inwardly-extending bottom surface and the first and second fin portions each define a mating surface for a respective panel of a reclosable bag; and a slider disposed on the first and second tracks and engaging the first and second retention features, the slider having a top wall and a bottom surface disposed level with or above the bottom surface of each of the first and second interlocking elements, the slider interlocking the first and second engagement profiles together when moved from an open position toward a closed position along the first and second tracks, wherein the first and second tracks and the slider are adapted to permit the first and second fins portions to extend outward from the first and second engagement profiles to define an angle of about 180 degrees between the mating surfaces of the first and second fin portions and adjacent the bottom surface of one of the first and second interlocking elements.

12. The reclosable fastener of claim 11, wherein:

the first retention feature comprises a first upward extension extending upwardly above the first engagement profile and defining a top of the first retention feature and a first outward extension extending outwardly from the first upward extension; and the second retention feature comprises a second upward extension extending upwardly above the second engagement profile and defining a top of the second retention feature and a second outward extension extending outwardly from the second upward extension.

13. The reclosable fastener of claim 12, wherein the slider comprises at least one sidewall extending downwardly from the top wall, the at least one sidewall having a projection extending therefrom to define at least a portion of the bottom surface of the slider.

14. The reclosable fastener of claim 13, wherein the at least one sidewall comprises a first sidewall and a second sidewall, the projection of the first sidewall defining a bottom boundary of a first channel and the projection of the second sidewall defining a bottom boundary of a second channel, the projections of the first sidewall and the second sidewall being configured to engage and inwardly deflect the first and second outward extensions to allow the first and second retention features to be retained within the first and second channels.

15. The reclosable fastener of claim 14, wherein the first outward extension defines a first undercut and the second outward extension defines a second undercut, the first and second retention features configured to be retained within the first and second channels with the projections of the first and second sidewalls abutting the first undercut and the second undercut, respectively.

16. The reclosable fastener of claim 15, wherein the slider comprises a separating finger extending from the top wall between the first and second sidewalls, the separating finger defining a side boundary of each of the first and second channels.

17. The reclosable fastener of claim 16, wherein the first and second upward extensions are configured to abut the separating finger when the first and second retention features are retained within the first and second channels.

18. The reclosable fastener of claim 16, wherein the separating finger interlocks the first and second engagement profiles when the slider is moved from the open position to the closed position.

19. The reclosable fastener of claim 11, wherein the bottom surface of the slider and the bottom surface of one of the first and second interlocking elements define a gap therebetween, the gap having a width of about 0.5 millimeters.

20. A method of forming a reclosable fastener comprising:

providing a first track comprising a first engagement profile and a first retention feature, the first retention feature disposed above a top of the first engagement profile, the first retention feature comprising a first upward extension extending upwardly above the first engagement profile and defining a top of the first retention feature and a first outward extension extending outwardly from the first upward extension, wherein the first engagement profile has a first interlocking element with an inwardly-extending bottom surface;

aligning a second track with the first track, the second track comprising a second engagement profile and a second retention feature, the second retention feature disposed above a top of the second engagement profile, the second retention feature comprising a second upward extension extending upwardly above the second engagement profile and defining a top of the second retention feature and a second outward extension extending outwardly from the second upward extension, wherein the second engagement profile has a second interlocking element with an inwardly-extending bottom surface;

pressing a slider onto the first and second tracks, the slider comprising a top wall, a first sidewall extending downwardly from the top wall, the first sidewall defining at least a portion of a first channel and having a first projection extending therefrom to define a bottom boundary of the first channel opposite the top wall, a second sidewall extending downwardly from the top wall, the second sidewall defining at least a portion of a second channel and having a second projection extending therefrom to define a bottom boundary of the second channel opposite the top wall, a bottom surface, and a separating finger extending from the top wall between the first and second sidewalls, the separating finger defining a side boundary of each of the first and second channels;

wherein, by pressing the slider on the first and second tracks, the first and second projections engage the first and second outward extensions thereby inwardly deflecting the first and second outward extensions to insert the first and second retention features into the first and second channels, the first and second retention features being retained within the first and second channels by the first and second projections; and wherein, by pressing the slider on the first and second tracks, the bottom surface of the slider is substantially level with or above the bottom surface of each of the first and second interlocking elements.

21. The method of claim 20, wherein the first outward extension defines a first undercut and the second outward extension defines a second undercut, the first and second retention features being retained by the first and second projection features in abutting relationship with the first and second undercuts.

22. The method of claim 20, wherein at least one of the first and second retention features has a generally L-shaped cross section.

23. The method of claim 20, wherein at least one of the first and second retention features has a generally wedge-shaped cross section.

24. The method of claim 20, the first outward extension defining a first width and the first upward extension defining a first height, the first height being greater than the first width.

25. The method of claim 24, the second outward extension defining a second width and the second upward extension defining a second height, the second height being greater than the second width.

26. The method of claim 25, wherein the first height is about 3 times the first width and the second height is about 3 times the second width.

* * * * *